US011803151B2

(12) United States Patent
Kang et al.

(10) Patent No.: US 11,803,151 B2
(45) Date of Patent: Oct. 31, 2023

(54) BUSH TILTABLE BY HEATING BELT

(71) Applicant: HEWLETT-PACKARD DEVELOPMENT COMPANY, L.P., Spring, TX (US)

(72) Inventors: Sung Woo Kang, Seongnam-si (KR); Sun Hyung Lee, Seongnam-si (KR); Sea Chul Bae, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/910,908

(22) PCT Filed: Mar. 10, 2021

(86) PCT No.: PCT/US2021/021692
§ 371 (c)(1),
(2) Date: Sep. 12, 2022

(87) PCT Pub. No.: WO2021/188336
PCT Pub. Date: Sep. 23, 2021

(65) Prior Publication Data

US 2023/0176518 A1 Jun. 8, 2023

(30) Foreign Application Priority Data

Mar. 20, 2020 (KR) ..... 10-2020-0034318

(51) Int. Cl.
*G03G 21/16* (2006.01)
*G03G 15/20* (2006.01)

(52) U.S. Cl.
CPC ..... *G03G 21/1647* (2013.01); *G03G 15/2053* (2013.01); *G03G 21/1685* (2013.01)

(58) Field of Classification Search
CPC ..... G03G 15/2053; G03G 21/1647; G03G 21/1685; G03G 2215/2016; G03G 2215/2038
See application file for complete search history.

(56) References Cited

U.S. PATENT DOCUMENTS

| | | | | |
|---|---|---|---|---|
| 10,386,761 | B2 | 8/2019 | Ohta et al. | |
| 2007/0160398 | A1 | 7/2007 | Lim | |
| 2009/0052957 | A1 | 2/2009 | Nishinoue | |
| 2013/0051878 | A1 | 2/2013 | Ishikawa et al. | |
| 2013/0322943 | A1 | 12/2013 | Iwakoshi et al. | |
| 2015/0037078 | A1* | 2/2015 | Ohta | G03G 15/2053 399/329 |

(Continued)

FOREIGN PATENT DOCUMENTS

| | | | |
|---|---|---|---|
| JP | 09-197757 | A | 7/1997 |
| JP | 2009-192726 | A | 8/2009 |

(Continued)

*Primary Examiner* — Sophia S Chen
(74) *Attorney, Agent, or Firm* — Foley & Lardner LLP

(57) ABSTRACT

A fuser includes a pressure roller to rotate and a heating belt to form a fixing nip with the pressure roller. The heating belt comprises at each end of the heating belt a bush to support the heating belt, a fixing flange to rotatably support the bush, and a plurality of springs to elastically connect between the bush and the fixing flange, to rotate the bush about an axis passing through a first surface of the bush and a second surface of the bush opposite to the first surface of the bush.

13 Claims, 13 Drawing Sheets

(56) References Cited

U.S. PATENT DOCUMENTS

| | | | | |
|---|---|---|---|---|
| 2016/0363891 | A1* | 12/2016 | Lee | G03G 15/2053 |
| 2017/0060056 | A1 | 3/2017 | Furusawa | |
| 2018/0188672 | A1 | 7/2018 | Kawai | |
| 2019/0086847 | A1* | 3/2019 | Tanaka | G03G 15/2053 |
| 2019/0196373 | A1 | 6/2019 | Osada et al. | |
| 2020/0285183 | A1 | 9/2020 | Kajita et al. | |

FOREIGN PATENT DOCUMENTS

| | | | |
|---|---|---|---|
| JP | 4622224 | B2 | 2/2011 |
| KR | 10-0677628 | B1 | 2/2007 |

* cited by examiner

BUSH TILTABLE BY HEATING BELT

BACKGROUND

An image forming apparatus prints an image on a print medium, and corresponds to a printer, a copying machine, a facsimile, and a multi-function printer that integrally implements functions thereof. An electrophotographic image forming apparatus forms a developer image corresponding to print data on the print medium, and uses a fuser that permanently fixes the developer image on the print medium by applying predetermined heat and pressure to the developer image.

The fuser may include a pressure roller for applying a predetermined pressure to the print medium, a heating belt for applying a predetermined heat to the print medium, and bushes installed on both ends of the heating belt to support the heating belt.

BRIEF DESCRIPTION OF THE DRAWINGS

The above and/or other aspects of the disclosure will be more apparent by describing certain examples of the present disclosure with reference to the accompanying drawings, in which.

DETAILED DESCRIPTION

Hereinafter, diverse examples will be described in detail with reference to the accompanying drawings. The examples described below may be modified and implemented in various different forms. In order to more dearly describe the features of the examples, a detailed description of known matters to those skilled in the art to which the examples below pertain will be omitted.

Meanwhile, in the specification, when any one component is referred to as being "connected to" another component, it means that any one component and another component are 'directly connected to' each other or are 'connected to' each other while having the other component interposed therebetween'. In addition, when any one component is referred to as "including" another component, it means that other components are not excluded but may be further included, unless explicitly described to the contrary.

In addition, an "image forming apparatus" may refer to an apparatus that prints print data generated by a terminal device such as a computer onto a recording print medium. Examples of such an image forming apparatus may include a copy machine, a printer, a facsimile, and a multi-function printer (MFP) that complexly implements the functions of the copy machine, the printer, and the facsimile through a single device.

It should be understood that the examples described below are illustratively shown to help understanding of the disclosure, and that the disclosure may be implemented in various modifications, unlike the examples described herein.

However, in the following description of the disclosure, when it is determined that a detailed description of related known functions or components may unnecessarily obscure the subject matter of the disclosure, the detailed description and specific illustration will be omitted. Further, the accompanying drawings are not illustrated to scale, but sizes of some of components may be exaggerated to help the understanding of the disclosure.

Figure 1:
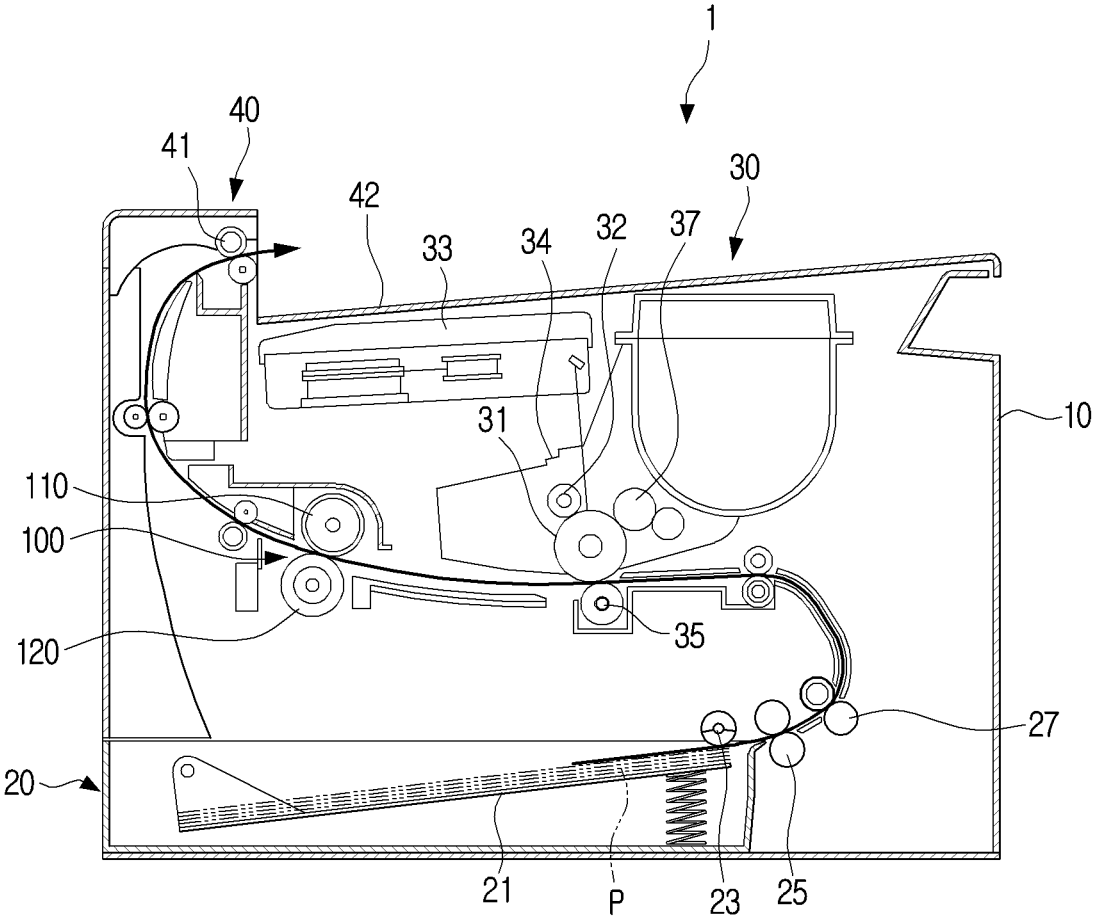
FIG. 1 is a cross-sectional view schematically illustrating an image forming apparatus including a fuser according to an example.

FIG. 1 is a cross-sectional view schematically illustrating an image forming apparatus 1 including a fuser 100 according to an example.

An image forming apparatus 1 may include a main body 10, a paper feeding apparatus 20, a print engine 30, a fuser 100 and a discharge apparatus 40.

The main body 10 may form an external appearance of the image forming apparatus 1 and may support various parts installed therein.

The paper feeding apparatus 20 may include a paper feeding tray 21 on a lower side of the main body 10, a pick-up roller 23 that picks up print media P loaded on the paper feeding tray 21 one by one, a registration roller 25 that provides a transport force to the picked-up print medium P and aligns the print medium P so that an image may be transferred to a desired portion of the print medium P, and a paper feeding roller 27 that feeds the print medium P between a photosensitive drum 31 and a transfer roller 35.

The print engine 30 may form a predetermined image on the print medium P supplied from the paper feeding apparatus 20. The print engine 30 may include a photosensitive drum 31, a charger 32, an exposure machine 33, a developing machine 34, and a transfer roller 35.

An electrostatic latent image may be formed on the photosensitive drum 31. For example, an image may be formed on the photosensitive drum 31 by operations of the charger 32 and the exposure machine 33 to be described later.

Hereinafter, in order to facilitate the description, a configuration of the print engine 30 corresponding to one color will be described as an example, but the print engine may include a plurality of photosensitive drums 31, a plurality of chargers 32, a plurality of exposure machines 33, and a plurality of developing machines 34 corresponding to a plurality of colors, an intermediate transfer belt, and the like.

The charger 32 may charge a surface of the photosensitive drum 31 to a uniform potential The exposure machine 33 may form the electrostatic latent image on the surface of the photosensitive drum 31 by changing the surface potential of the photosensitive drum 31 according to image information to be printed.

The developing machine 34 may accommodate a developing solution therein, and supply the developing solution (e.g., a toner) to the electrostatic latent image to develop the electrostatic latent image into a visible image. The developing machine 34 may include a developing roller 37 that supplies the developing solution to the electrostatic latent image.

The transfer roller 35 may be installed to face an outer circumference surface of the photosensitive drum 31.

The fuser 100 may apply heat and pressure to a print medium P while the print medium P to which a developer image has been transferred from the print engine 30 passes through the fuser 100 to fix the developer image on the print medium P.

In addition, the discharge apparatus 40 may include an exit roller 41 for discharging the print medium P having a predetermined image printed thereon through the fuser 100 to an exit tray 42 outside the main body 10.

The configuration of the image forming apparatus 1 according to one example has been described in detail above, but the development method is not limited thereto and the configuration of the image forming apparatus 1 according to the development method may be variously modified and changed.

Hereinafter, the fuser 100 according to an example will be described in detail with reference to the drawings.

Figure 2:
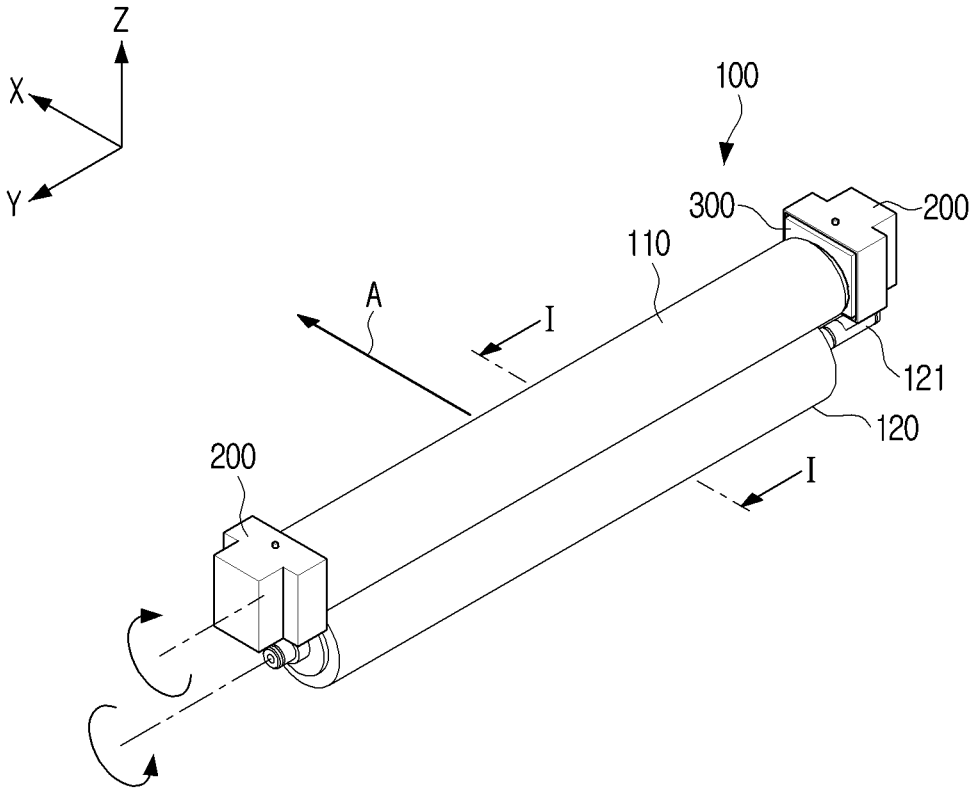
FIG. 2 is a perspective view illustrating a fuser according to an example.
Figure 3:
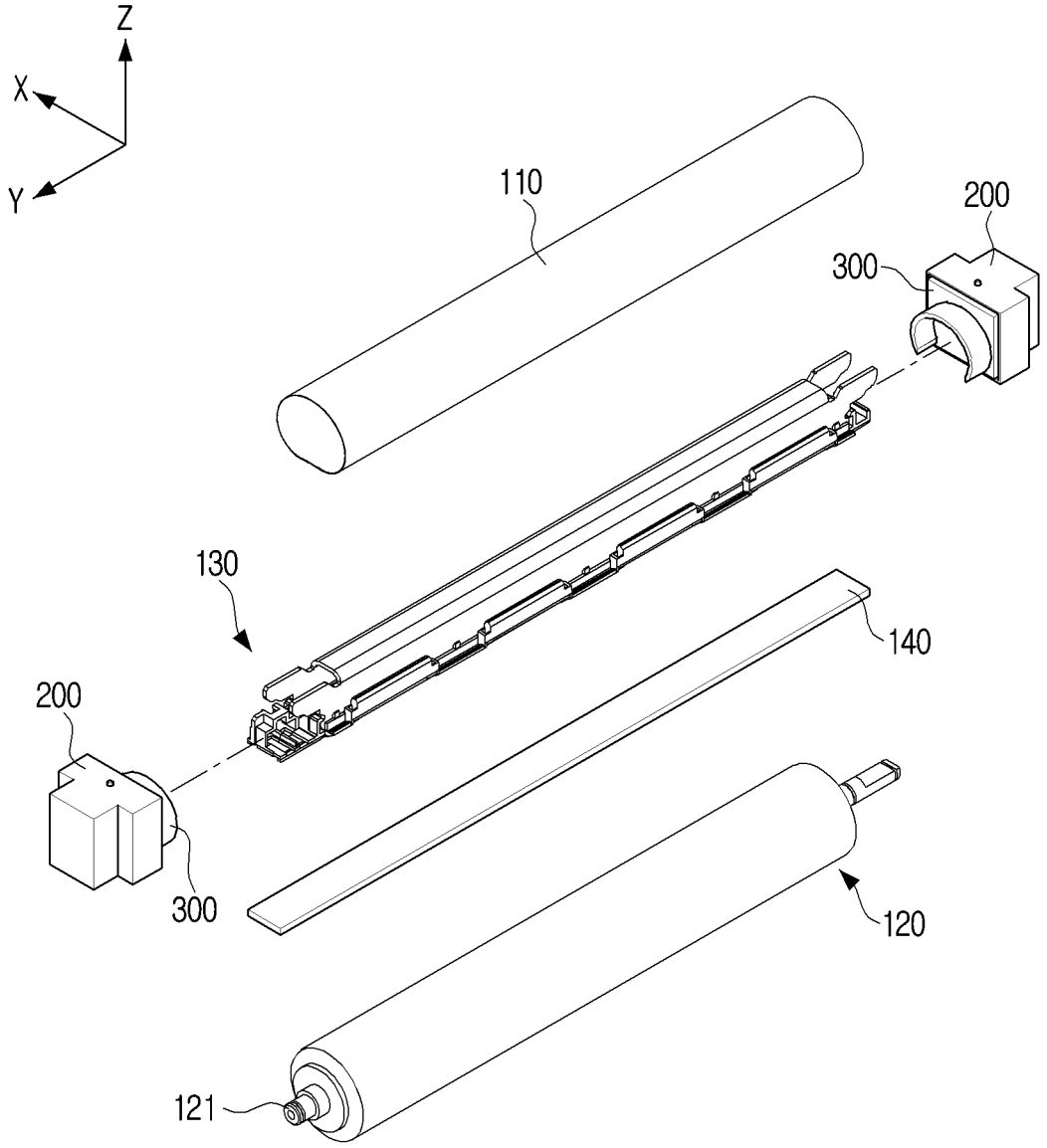
FIG. 3 is an exploded perspective view of the example of the fuser illustrated in FIG. 2.
Figure 4:
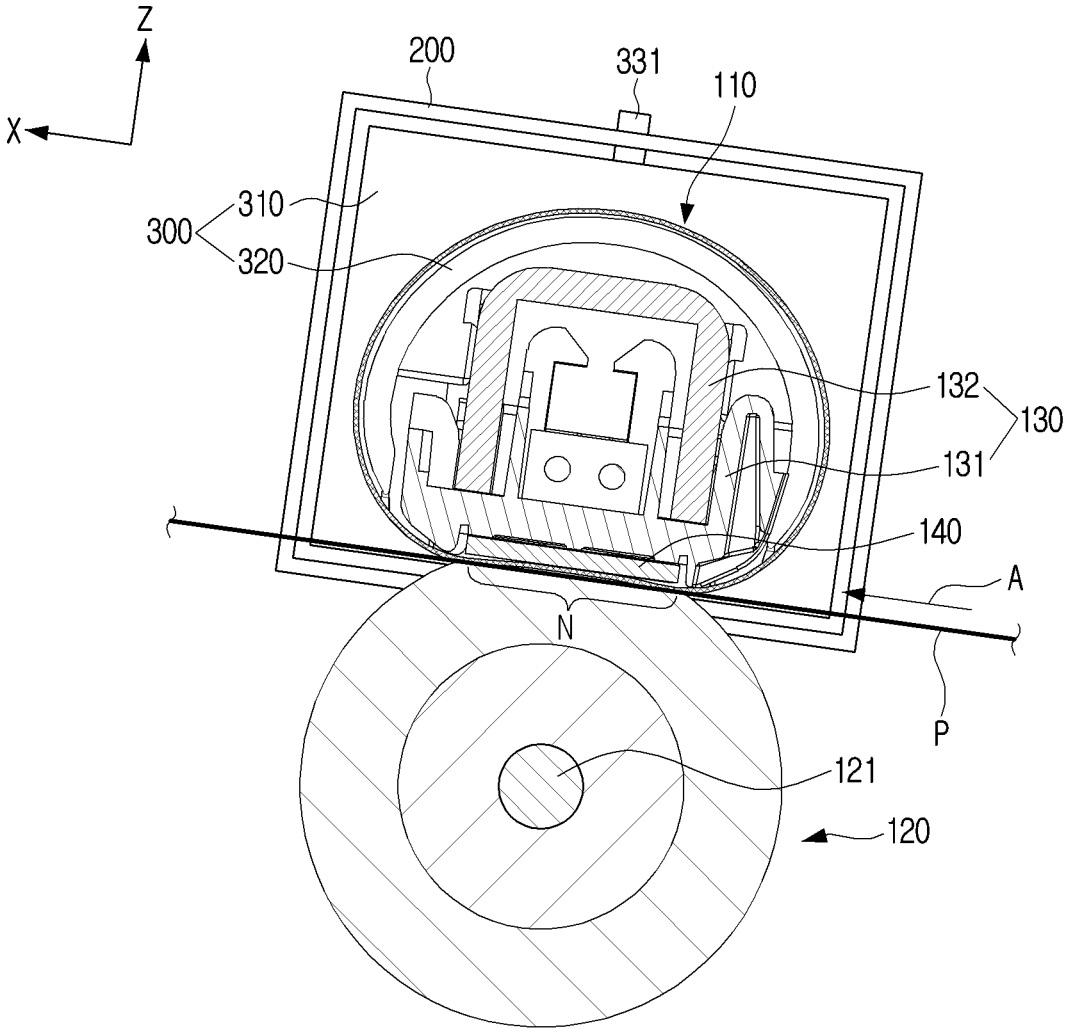
FIG. 4 is a cross-sectional view taken along a line I-I indicated in the example of FIG. 2.

FIG. 2 is a perspective view illustrating a fuser 100 according to an example. FIG. 3 is an exploded perspective view of the fuser 100 illustrated in FIG. 2. FIG. 4 is a cross-sectional view taken along a line I-I indicated in FIG. 2.

Referring to FIGS. 2 to 4, the fuser 100 may apply heat and pressure to the print medium P to fix the transferred developer image on the print medium, and may include a heating belt 110, a pressure roller 120, a nip forming member 130, a heat source 140, fixing flanges 200, and bushes (or bushings) 300.

The heating belt 110 may have the heat source 140 for providing heat to the print medium on which an image is transferred from the developing machine. For example, the heating belt 110 may apply predetermined heat to the print medium P, and the heating belt 110 according to an example may be illustrated as being formed of a belt type, but is not limited thereto and may be formed of a roller type.

The heating belt 110 may be heated by a heat source 140, which will be described later, to transfer heat to the print medium P passing by path A between the heating belt 110 and the pressure roller 120.

The heating belt 110 may be installed to face the pressure roller 120 and may form a fixing nip N through which the print medium P passes by path A together with the pressure roller 120.

The pressure roller 120 may rotate around a rotation shaft 121. When the heating belt 110 rotates, the pressure roller 120 may passively rotate by a frictional force between the heating belt 110 and the pressure roller 120.

An axial length of the heating belt 110 may be longer than the axial length of the pressure roller 120. The heating belt 110 may include a single layer of metal, heat-resistant polymer, or the like, or may, in addition, include an elastic layer and a protective layer to a base layer formed of metal or heat-resistant polymer.

For example, the heating belt 110 may include at least one material of, for example, polyimide resin or steel use stainless (SUS).

The pressure roller 120 may be installed to face the heating belt 110 so that constant fixing pressure is maintained between the heating belt 110 and the pressure roller 120. For example, the pressure roller 120 may apply a predetermined pressure to the print medium P, and may be formed in a roller shape. The pressure roller 120 may be configured to rotate by receiving power from a driving source such as a motor.

The nip forming member 130 may be installed inside the heating belt 110, and may support an inner surface of the heating belt 110 so that the heating belt 110 is in contact with the pressure roller 120 to form the fixing nip N.

In addition, a length of the nip forming member 130 may be longer than that of the pressure roller 120. Therefore, when the pressure roller 120 may be in contact with the heating belt 110 to form the fixing nip N, bending of both ends of the heating belt 110 by the pressure roller 120 may be prevented.

The nip forming member 130 may include a guide member 131 that guides and presses the heating belt 110 by contacting the inner surface of the heating belt 110, and a stay 132 disposed on the guide member 131 to support the guide member 131.

The guide member 131 may be in contact with the inner surface of the heating belt 110 to form the fixing nip N, and may guide the heating belt 110 so that the heating belt 110 may run smoothly in the vicinity of the fixing nip N. The guide member 131 may be formed in a channel shape having a U-shaped cross section with a substantially flat bottom, and may be installed with the stay 132 therein.

The stay 132 may reinforce the guide member 131 to minimize bending deformation of the guide member 131. The stay 132 may be formed in a channel shape having a U-shaped cross section with a substantially flat bottom, and be installed inside the guide member 131. The stay 132 may be formed in a structure having a large cross-sectional moment of inertia such as, for example, an I-beam or an H-beam, in addition to the U-shape having the flat bottom.

As illustrated in FIG. 4, a lower surface of the nip forming member 130, that is, a lower surface of the guide member 131 may be in contact with the inner surface of the heating belt 110, and an upper portion of the pressure roller 120 in contact with a portion of the heating belt 110 supported by the lower surface of the guide member 131 may form the fixing nip N.

The heat source 140 may generate heat to fix an image, and may be a heat lamp (e.g., a halogen lamp) or a heating resistance. The heat source 140 may be disposed inside the heating belt 110 along a rotation shaft of the heating belt 110.

For example, the heat source 140 may be disposed on a bottom surface of the nip forming member 130. In this example, a heat shield member which prevents the heat generated from the heat source 140 from being directly radiated to the nip forming member 130 may be disposed between the nip forming member 130 and the heat source 140. The heat source 140 may be configured as various heat sources such as a halogen lamp, a heating wire, or an induction heater.

A pair of fixing flanges 200 may be respectively disposed at both ends of the heating belt 110, and accommodate at least a portion of the bush 300 and rotatably support the bush 300, which will be described in detail below A pair of bushes 300 may be respectively disposed at both ends of the heating belt 110, and support the inner surfaces of both ends of the heating belt 110 and limit the movement of the heating belt 110 in the axial direction, which will be described in detail below.

Figure 5:
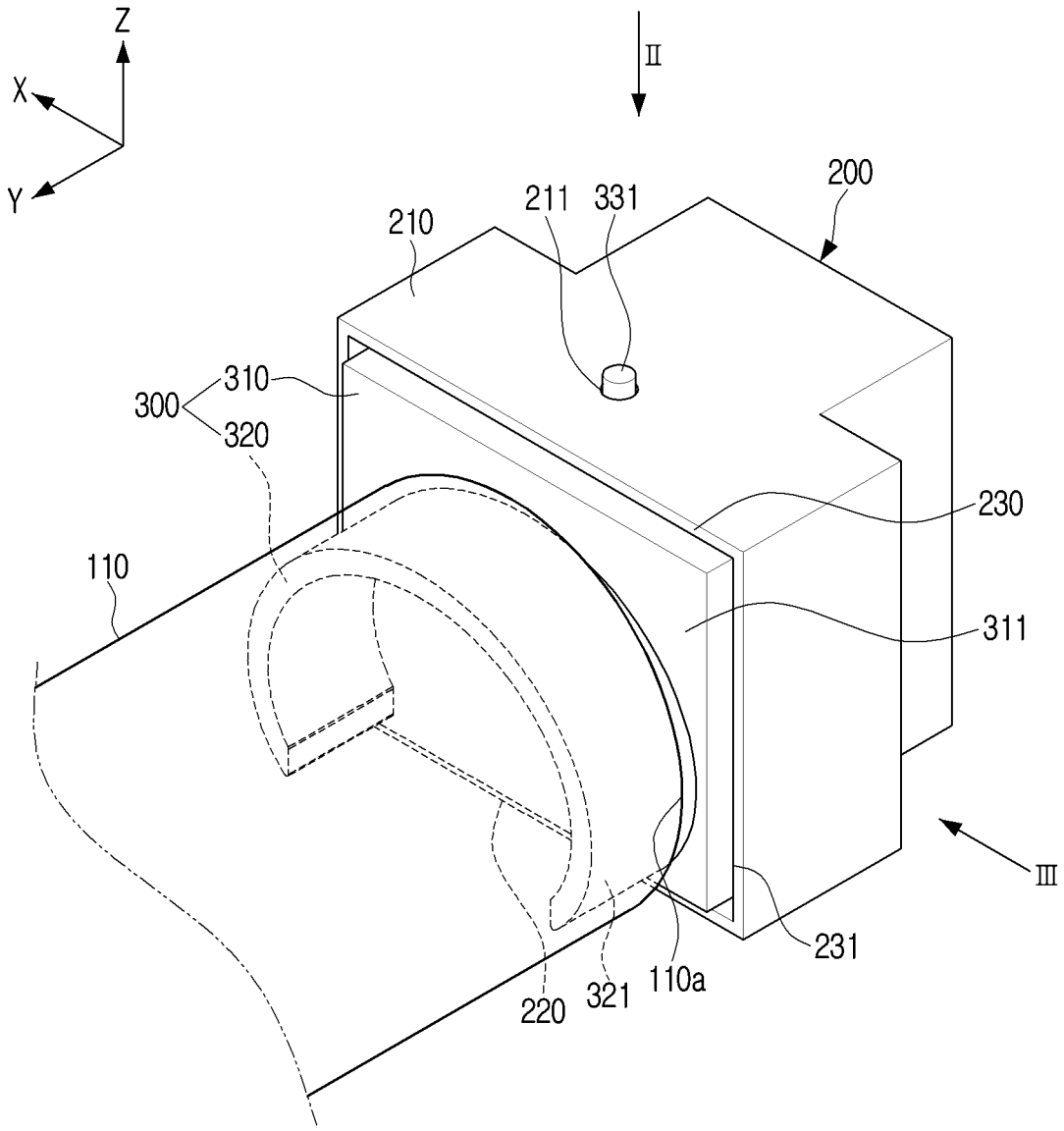
FIG. 5 is a partial perspective view of an example in which a bush supports a heating belt.
Figure 6:
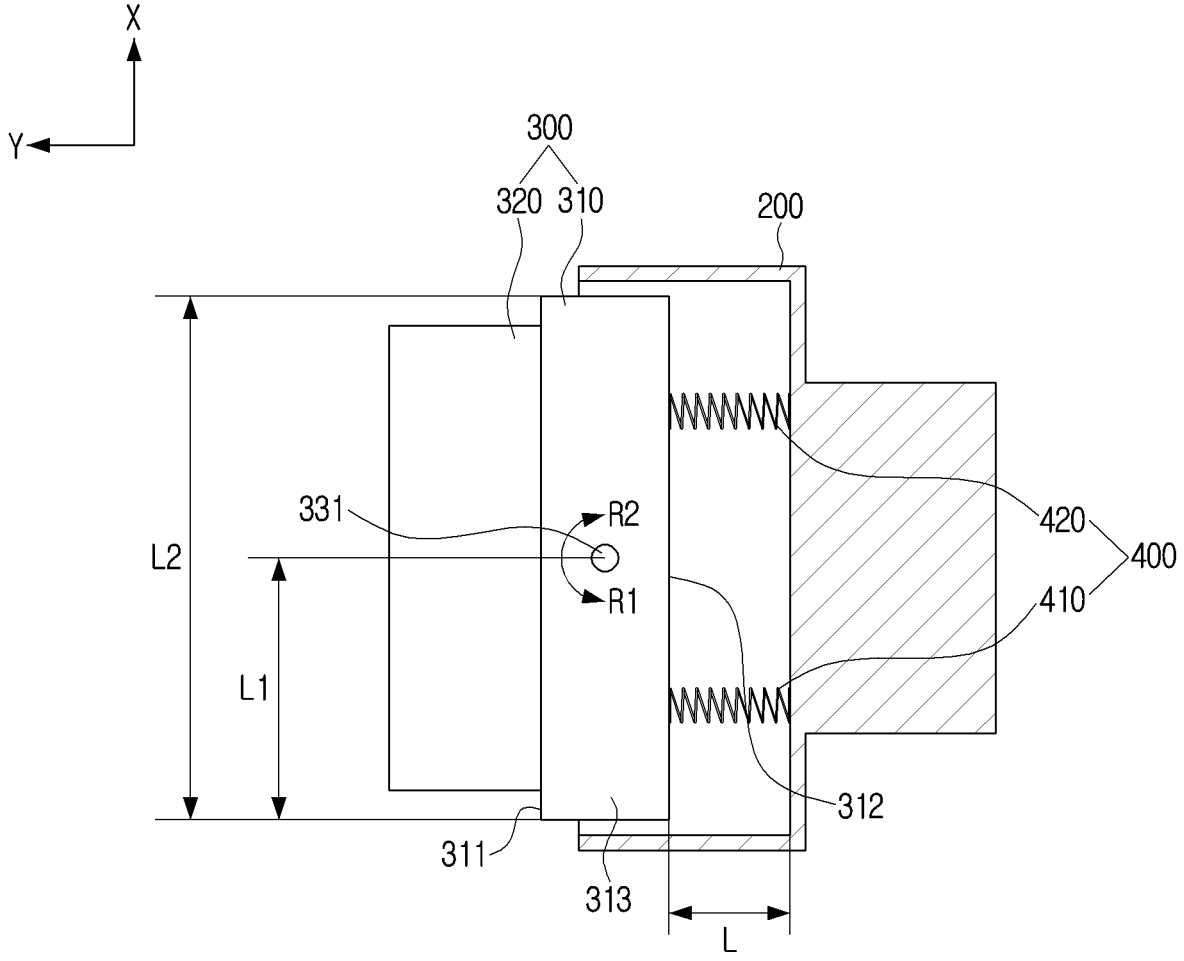
FIG. 6 is a cross-sectional view of an example in which a fixing flange supports the bush when viewed from a direction II in FIG. 5.

FIG. 5 is a partial perspective view illustrating an example in which a bush 300 supports a heating belt 110. FIG. 6 is a cross-sectional view illustrating an example in which a fixing flange 200 supports the bush 300 when viewed from a direction II in FIG. 5.

Referring to FIGS. 5 and 6, the bush 300 that supports both ends of the heating belt, may include a side wall 310 and a support member 320.

The side wall 310 may be disposed outside the both ends of the heating belt 110 to be rotatably supported by the fixing flange 200. The side wall 310 may be formed in a substantially rectangular parallelepiped shape, but is not limited thereto.

A regulating surface 311 for regulating an axial movement of the heating belt 110 may be provided on a front surface of the side wall 310. Accordingly, when one end 110*a* of the heating belt 110 is in contact with the regulating surface 311, the heating belt 110 may no longer move in the axial direction.

The support member 320 may be formed to protrude toward the heating belt 110 with respect to the side wall 310, and support the inner surface of the heating belt 110 so that the heating belt 110 may rotate.

The support member 320 may have an arch shape, but is not limited thereto, and may be formed in various shapes as long as it may provide a path through which the heating belt 110 may naturally rotate.

A guide surface 321 facing the inner surface of the heating belt 110 may be provided on an upper side of the support member 320. That is, the inner surface of the heating belt 110 may rotate in contact with all or a part of the guide surface 321.

The flange 200 may be disposed outside the both ends of the heating belt 110 to accommodate at least a portion of the bush 300 and to rotatably support the bush 300.

For example, the fixing flange 200 may include an accommodating groove 231 that is drawn into the front surface 230 by a predetermined depth. At least a portion of the side wall 310 of the bush 300 may be accommodated in an inner space of the accommodating groove 231.

The fixing flange 200 may be coupled in the form in which at least a portion of the side wall 310 may be fitted into the accommodating groove 231, and a lower surface 314 (shown in FIG. 11) of the side wall 310 may be supported on the inner surface of the fixing flange 200, but the coupling method is not limited thereto.

The bush 300 may include a first boss 331 and a second boss 332 (shown in FIG. 11) protruding from an upper surface 313 and a lower surface 314 (shown in FIG. 11) of the side wall 310, respectively. In addition, the fixing flange 200 may include a first hole 211 and a second hole 221 (shown in FIG. 11) in which the first and second bosses 331 and 332 are respectively fitted to an upper surface 210 and a lower surface 220, respectively.

As the first and second bosses 331 and 332 may be fitted into the first and second holes 211 and 221, respectively, the bush 300 may be stably supported by the fixing flange 200, and may rotate in a first direction R1 and a second direction R2 about an axis passing through the first and second bosses 331 and 332.

The first and second bosses 331 and 332 may be disposed on the same vertical axis (an axis parallel to a Z axis), For example, a distance L1 between the first and second bosses 331 and 332 and one side surface of the side wall 310 may be ½ of a distance L2 between both side surfaces of the side wall 310. Accordingly, the bush 300 may rotate in the first and second directions R1 and R2 based on the same vertical axis where the first and second bosses are disposed.

A plurality of springs 400 may be disposed in the inner space of the fixing flange 200 to elastically connect between a rear surface 312 of the side wall 310 and the fixing flange 200.

The spring 400 may have one end connected to the rear surface 312 of the bush and the other end connected to the fixing flange 200 to contract and relax in a direction (a direction parallel to a Y axis) perpendicular to the rear surface 312 of the bush 300.

The spring 400 may include plural, or more than one, spring, and may have the same free length L. The free length may be the total length of the spring 400 when no load is applied to the spring 400, and as the plurality of springs 400 have the same free length L, the rear surface 312 of the bush 300 may be spaced apart from the fixing flange 200 by the same free length L.

Accordingly, when the springs 400 are not compressed or relaxed, the bush 300 may not be inclined in a specific direction and may be disposed parallel to a transport direction (X-axis direction) of the print medium P.

In addition, each of the plurality of springs 400 may be disposed side by side at the same height H1 (shown in FIG. 11) from a lower side of the bush. For example, the plurality of springs 400 may be disposed side by side at a height H1 corresponding to half of a height H2 (shown in FIG. 11) of the rear surface 312 of the bush 300. Accordingly, the bush 300 may rotate in the first direction R1 or the second direction R2 with respect to the axis parallel to the Z axis while being connected to the plurality of springs 400.

Although two springs 410 and 420 of the plurality of springs 400 are illustrated, the number of springs is not limited thereto, and the springs may be formed of two or more.

When one end 110*a* of the heating belt 110 may press the regulating surface 311 of the side wall 310, the plurality of springs 400 may be compressed to different lengths, so that the bush 300 may rotate in the first direction R1 or the second direction R2. A process of tilting the bush 300 by the heating belt 110 will be described later in detail with reference to FIGS. 7 and 8.

Figure 7:
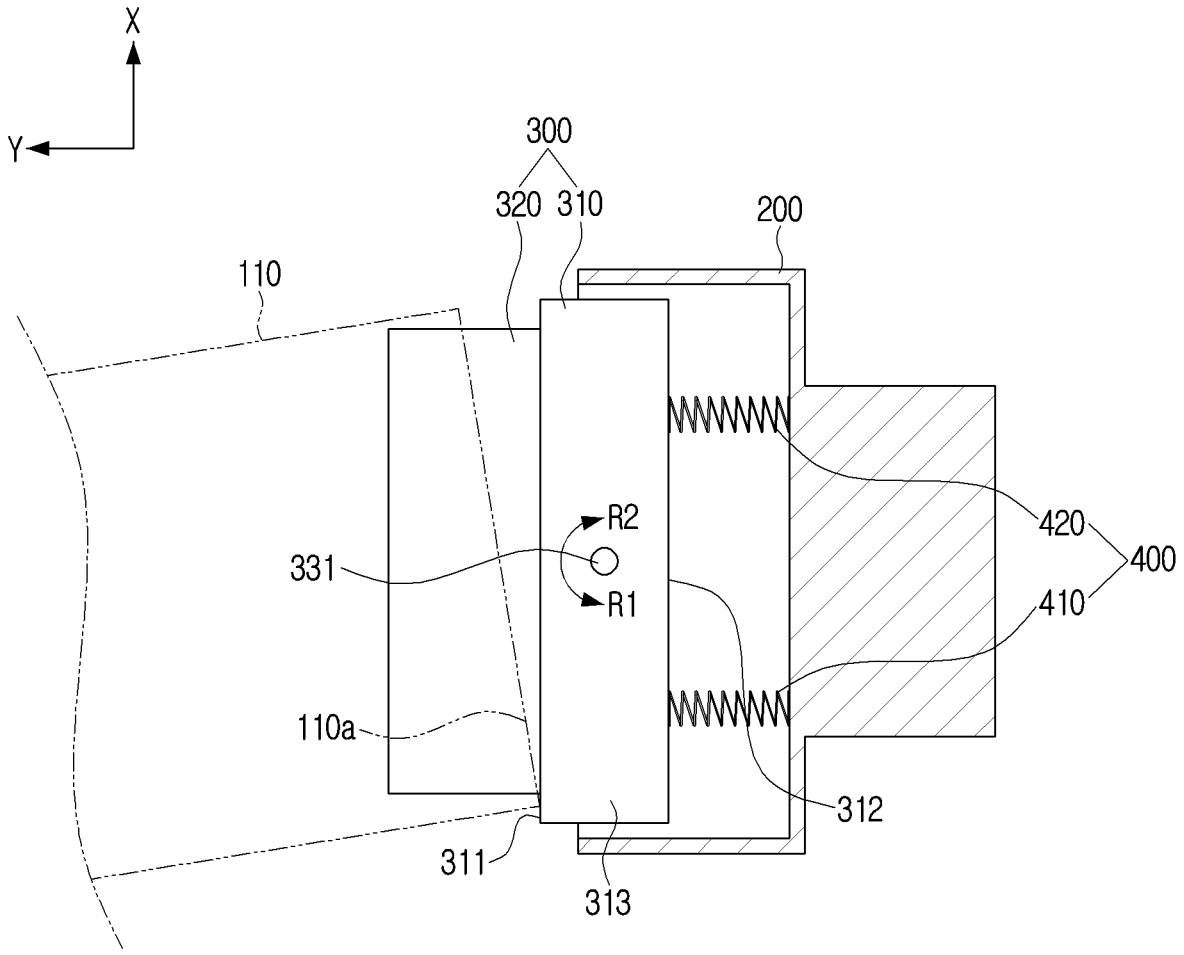
FIG. 7 is a cross-sectional view illustrating an example in which meandering occurs in the heating belt illustrated in the example of FIG. 6.
Figure 8:
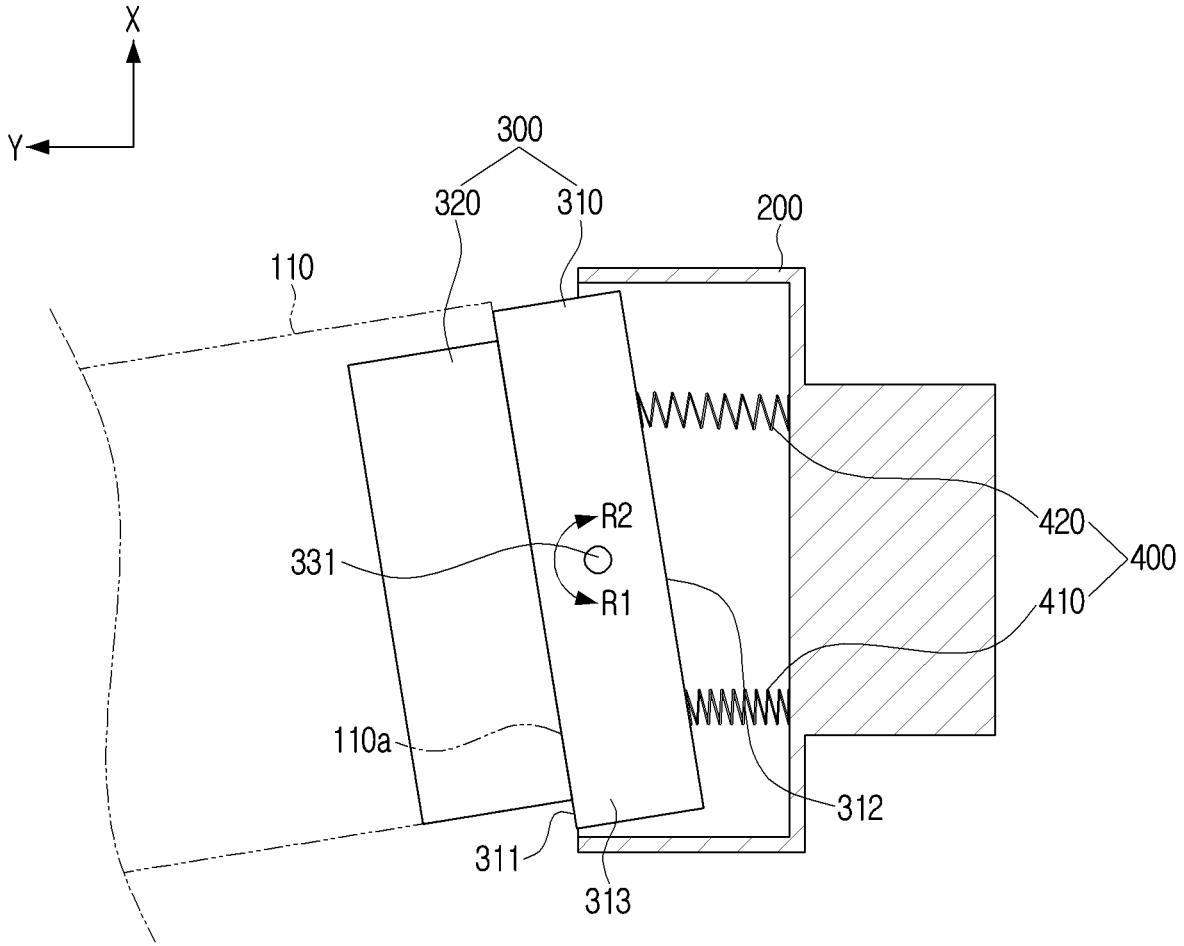
FIG. 8 is a cross-sectional view illustrating an example in which the bush illustrated in the example of FIG. 7 is tilted by the heating belt.

FIG. 7 is a cross-sectional view illustrating a state in which meandering occurs in the heating belt 110 illustrated in FIG. 6. FIG. 8 is a cross-sectional view illustrating a state in which the bush 300 illustrated in FIG. 7 is tilted by the heating belt 110.

The heating belt 110 may form a predetermined angle with the transport direction (X-axis direction) of the print medium P due to the precision of components or alignment errors when assembling the components, and may rotate in the first direction R1 or the second direction R2.

In addition, when the heating belt 110 may receive frictional force in the transport direction (X-axis direction) of the print medium P by the pressure roller 120 in the state in which the heating belt 110 is rotated, the heating belt 110 may move toward the side wall 310 of a left or right bush 300.

Referring to FIG. 7, the heating belt 110 may move to the right in a state rotated in the first direction R1, so that one end 110*a* thereof may press the side wall 310 of the bush 300. Accordingly, a spring 410 adjacent to a pressing point among the plurality of springs 400 may be compressed more than the rest of the springs 420, so that the bush 300 may rotate until the bush 300 is in surface-contact with one end 110*a* of the heating belt 110.

For example, as illustrated in FIG. 8, when the heating belt 110 rotated in the first direction R1 may press the side wall 310, a first spring 410 on the upstream side adjacent to the pressing point may be compressed more than a second spring 420 and the bush 300 may also rotate in the first direction R1, so that the side wall 310 and one end 110*a* of the heating belt 110 may be in surface-contact with each other.

Accordingly, stress may be not concentrated at any one point of one end 110*a* of the heating belt 110, but may be dispersed throughout the entire end 110*a*, thereby reducing abrasion occurring at one end 110*a* of the heating belt 110.

In addition, because the plurality of springs 400 may be returned to an original free length L by a restoring force, the bush 300 may rotate in the second direction R2 on the contrary. Accordingly, the side wall 310 of the bush 300 may press the heating belt 110 in the second direction R2, and the alignment of the heating belt 110 may be corrected to be parallel to the transport direction (X-axis direction) of the print medium P.

Until now, an example in which the heating belt 110 and the bush 300 rotate in the first direction R1 has been described, but the rotation direction is not limited thereto, and the same effect may be expected even when the heating belt 110 and the bush 300 rotate in the second direction R2.

That is, as the bush 300 may be tilted by the heating belt 110 and returned to its original state, regardless of the rotation and movement directions of the heating belt 110 in which the meandering occurs, the abrasion may be reduced at one end 110*a* of the heating belt 110, and the alignment of the heating belt 110 may be corrected to be parallel to the transport direction (X-axis direction) of the print medium P.

Figure 9:
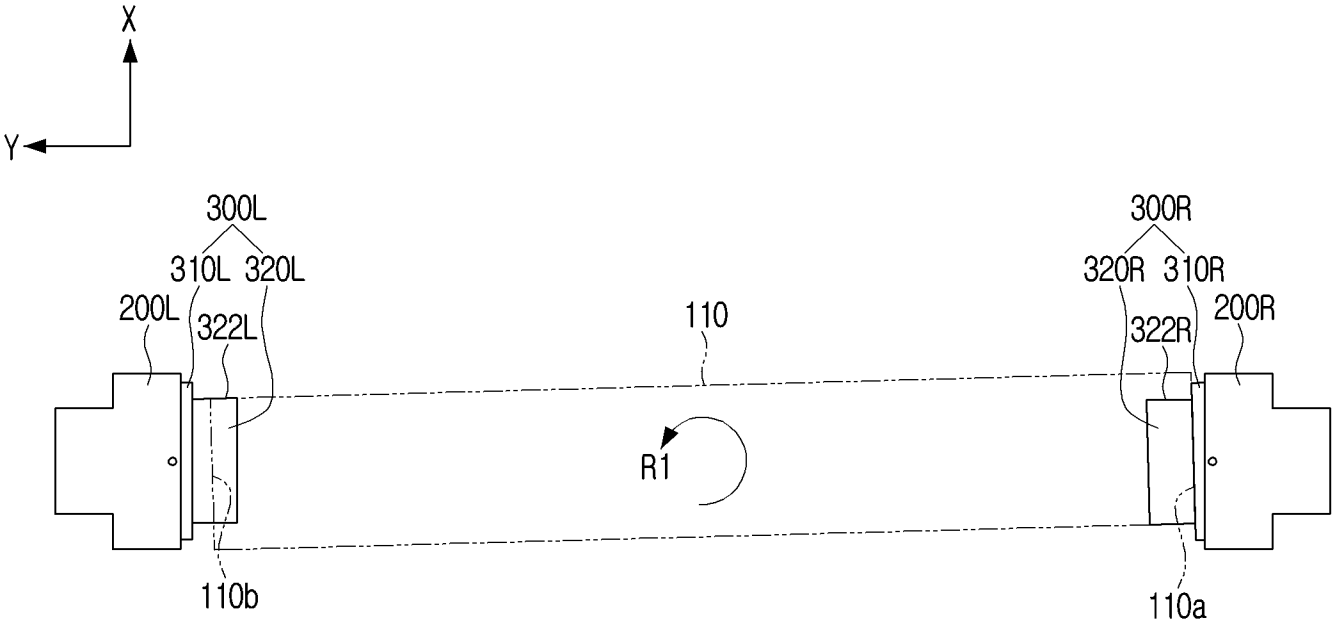
FIG. 9 is a top view illustrating an example in which one region on a downstream side of a support member is inclined downward toward a side wall.

FIG. 9 is a top view illustrating an example in which one region 322 on a downstream side of a support member 320 is inclined downward toward a side wall 310L and a fixing flange 200L with respect to a fixing flange 200R, a side wall 310R, a support member 320R, and a region 322R.

Referring to FIG. 9, the heating belt 110 may move to a right bush 300R while rotating in the first direction R1, and the right bush 300R may be rotated in the first direction R1 and tilted according to the process described above. On the other hand, a left bush 300L may maintain a state in which the heating belt 110 is not tilted and is parallel to the transport direction (X-axis direction) of the print medium P.

In this case, if one region 322L on the downstream side of a left support member 320L is formed perpendicular to the side wall 310L, the other end 110*b* of the heating belt 110 may be in point contact with one region 322L on the downstream side of the support member 320L and the abrasion of the heating belt 110 and the support member 320L may be intensified. Therefore, stress may be concentrated on the other end 110*b* of the heating belt 110 and may cause damage to the heating belt 110.

Accordingly, the support member 320 according to an example may be formed such that one region 322 on the downstream side of the transport direction (X-axis direction) of the print medium P may be inclined downward toward the side wall 310L. For example, one region 322 on the downstream side of the support member 320 may be formed to be inclined at the same angle as the inclined angle of the heating belt 110.

That is, because the inner surface of the heating belt 110 adjacent to the other end 110*b* of the heating belt 110 may be in surface contact with one inclined region 322L on the downstream side of the left support member 320L, the abrasion occurring on the inner surface of the other end 110*b* of the heating belt 110 may be reduced. In addition, because the support member 320L also has the stress from the heating belt 110 dispersed to one region 322L on the downstream side, the abrasion and stress thereof may be reduced.

Figure 10:
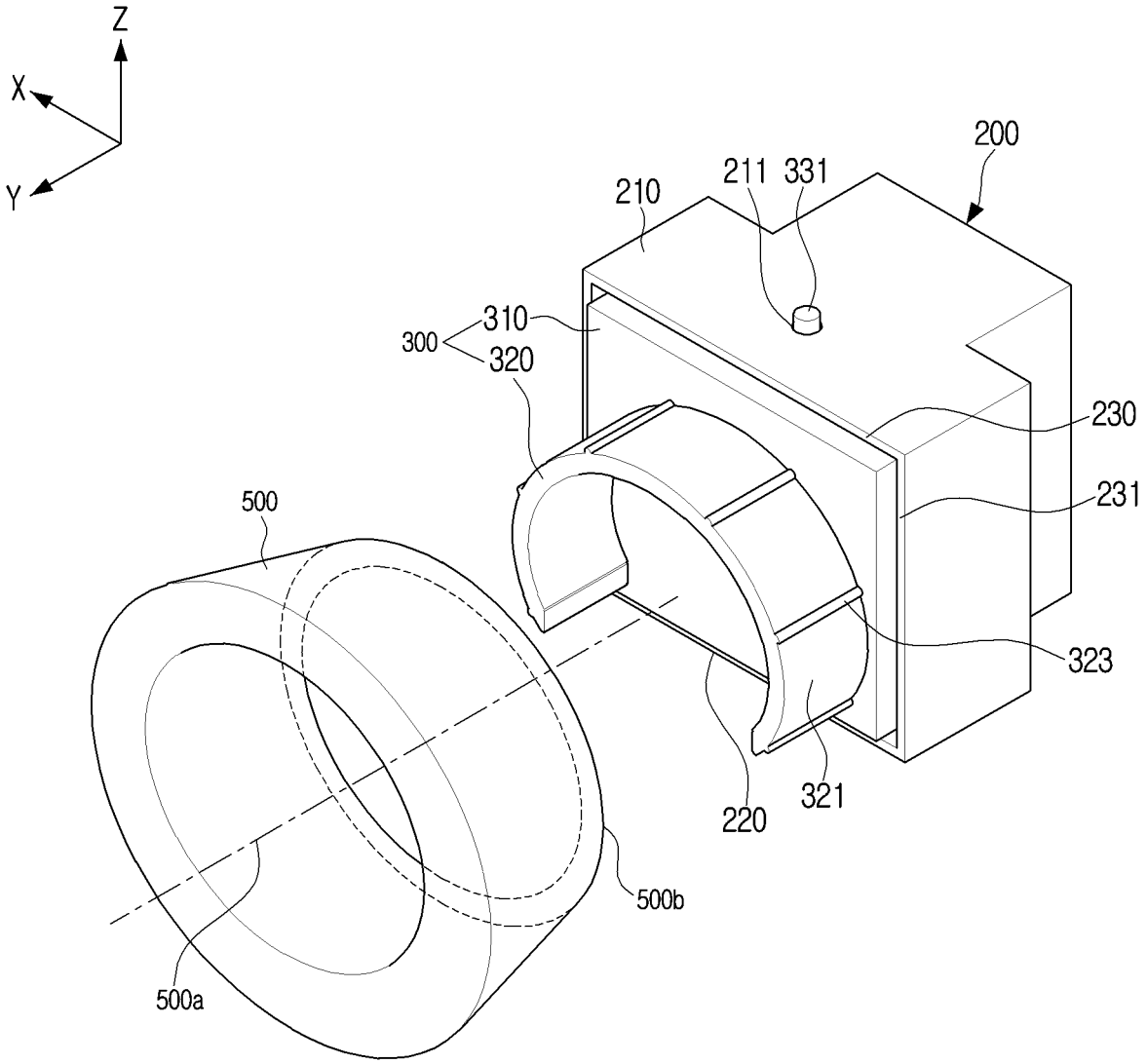
FIG. 10 is an exploded perspective view illustrating an example in which the support member supports a rotating ring.

FIG. 10 is an exploded perspective view illustrating an example in which the support member 320 supports a rotating ring 500. Referring to FIG. 10, the fuser 100 according to an example may include a rotating ring 500 that supports the inner surface of the heating belt 110 and rotates by the heating belt 110.

The rotating rings 500 may be respectively disposed at both ends of the heating belt 110 and may be rotatably supported by the support member 320. As the rotating ring 500 is disposed between the heating belt 110 and the support member 320, the heating belt 110 does not rotate while being in friction directly with the support member 320, but may rotate together with a rotatable rotating ring 500, thereby minimizing fatigue cracks occurring at both ends of the heating belt 110.

The rotating ring 500 may have a cylindrical shape, but the shape of the rotating ring 500 is not limited thereto, and may have a truncated cone shape with a smaller cross-sectional area toward the side wall 310 of the bush 300. For example, an outer diameter of one end 500*a* of the rotating ring 500 may be greater than a diameter of the other end 500*b* adjacent to the side wall 310.

In addition, the support member 320 may include protrusions 323 protruding from portions where the rotating ring 500 contacts, so that the lifespan of the rotating ring 500 and the heating belt 110 may be extended. The protrusion 323 may be formed in a spherical shape and may be formed in a column shape having a semi-circular or arc-shaped cross section, but the shape is not limited thereto.

As the protrusion 323 is formed on the guide surface 321 of the support member 320, a contact area between an inner surface of the rotating ring 500 and the support member 320 may be reduced, thereby reducing frictional force between the support member 320 and the rotating ring 500. Accordingly, the rotating ring 500 may freely rotate at a speed substantially equal to a rotational speed of the heating belt 110, and abrasion occurring by the rotating ring 500 on the inner surface of the heating belt 110 may be reduced.

In addition, when the rotating ring 500 having the truncated cone shape is supported by the support member 320, the rotating ring 500 may have the same shape as the support member 320 in which one region 322 illustrated in FIG. 9 may be formed to be inclined downward toward the side wall. Accordingly, because the inner surface of the heating belt 110 tilted in a specific direction may be in surface contact with the rotating ring 500, the abrasion occurring on the inner surface of the heating belt 110 may be reduced. In addition, because stress caused by the heating belt 110 may be dispersed to an outer side surface, abrasion of the rotating ring 500 may also be reduced.

Figure 11:
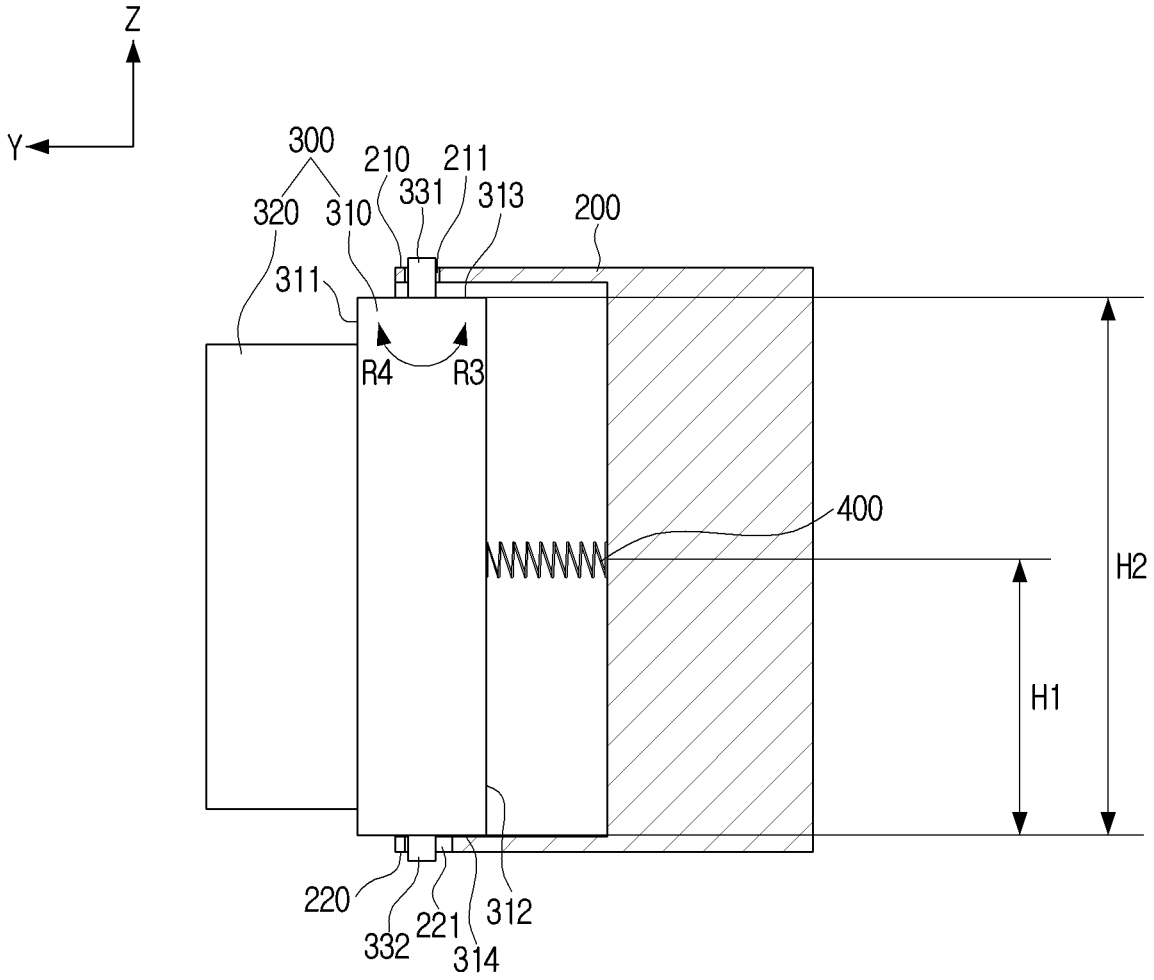
FIG. 11 is a cross-sectional view illustrating an example in which the fixing flange supports the bush when viewed from a direction III in FIG. 5.

FIG. 11 is a cross-sectional view illustrating an example in which a fixing flange 200 supports the bush 300 when viewed from a direction III in FIG. 5. Referring to FIG. 11, the bush 300 may include a first boss 331 and a second boss 332 protruding from an upper surface 313 and a lower surface 314 of the side wall 310, respectively, and the fixing flange 200 may include first and second holes 211 and 221 into which the first and second bosses 331 and 332 are respectively fitted to the upper surface 210 and the lower surface 220.

The first and second bosses 331 and 332 may be disposed on the same vertical axis (an axis parallel to the Z axis). The first hole 211 may have a shape corresponding to the first boss 331, and the second hole 221 may have a longer length in a direction (a direction parallel to the Y axis) perpendicular to the rear surface 312 of the bush 300 than the first hole 211.

Accordingly, the bush 300 may rotate in a third direction R3 and a fourth direction R4 based on the first boss 331 as well as the first and second directions R1 and R2 described above.

The second hole 221 may have an elliptical cross-section, but is not limited thereto, and may have a rectangular shape having a longer horizontal length. Accordingly, the second boss 332 may move more freely while being fitted to the second hole 221.

Figure 12:
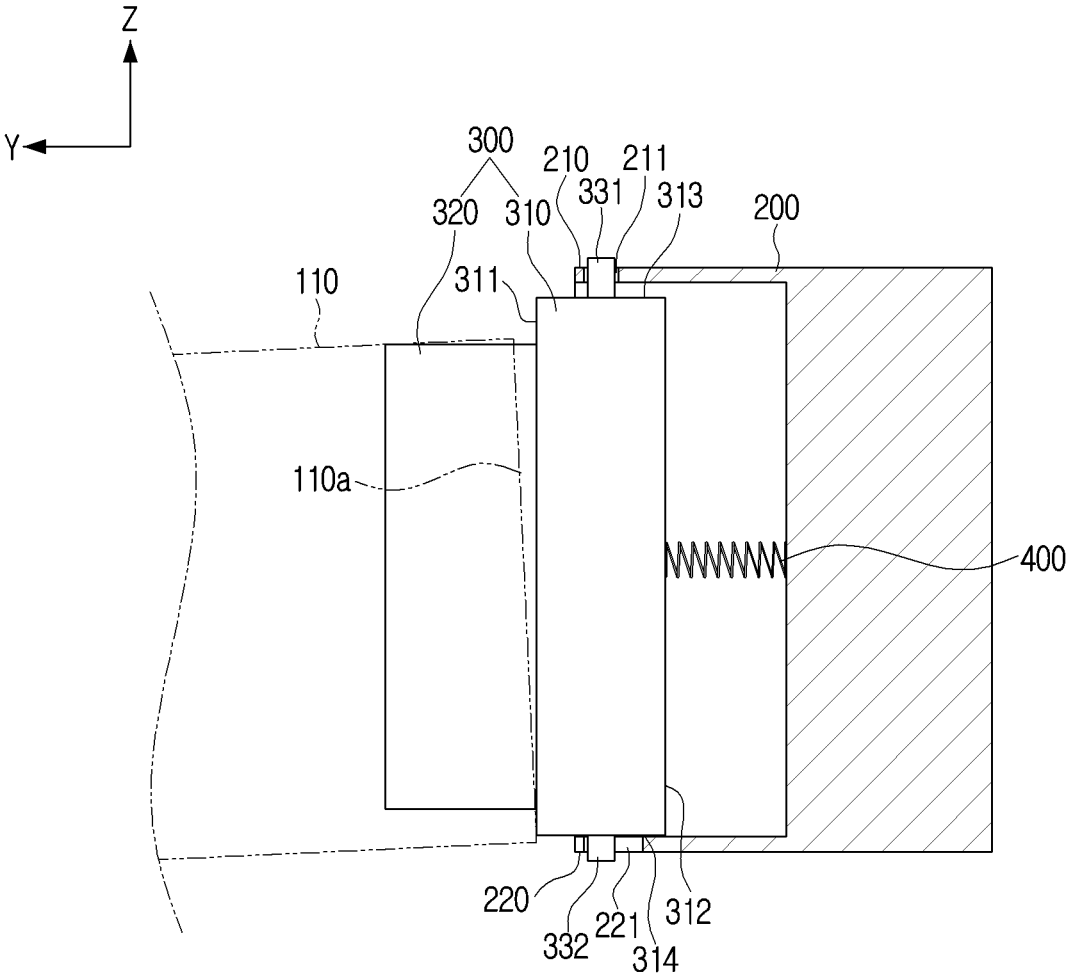
FIG. 12 is a cross-sectional view illustrating an example in which meandering occurs in the heating belt illustrated in FIG. 11.
Figure 13:
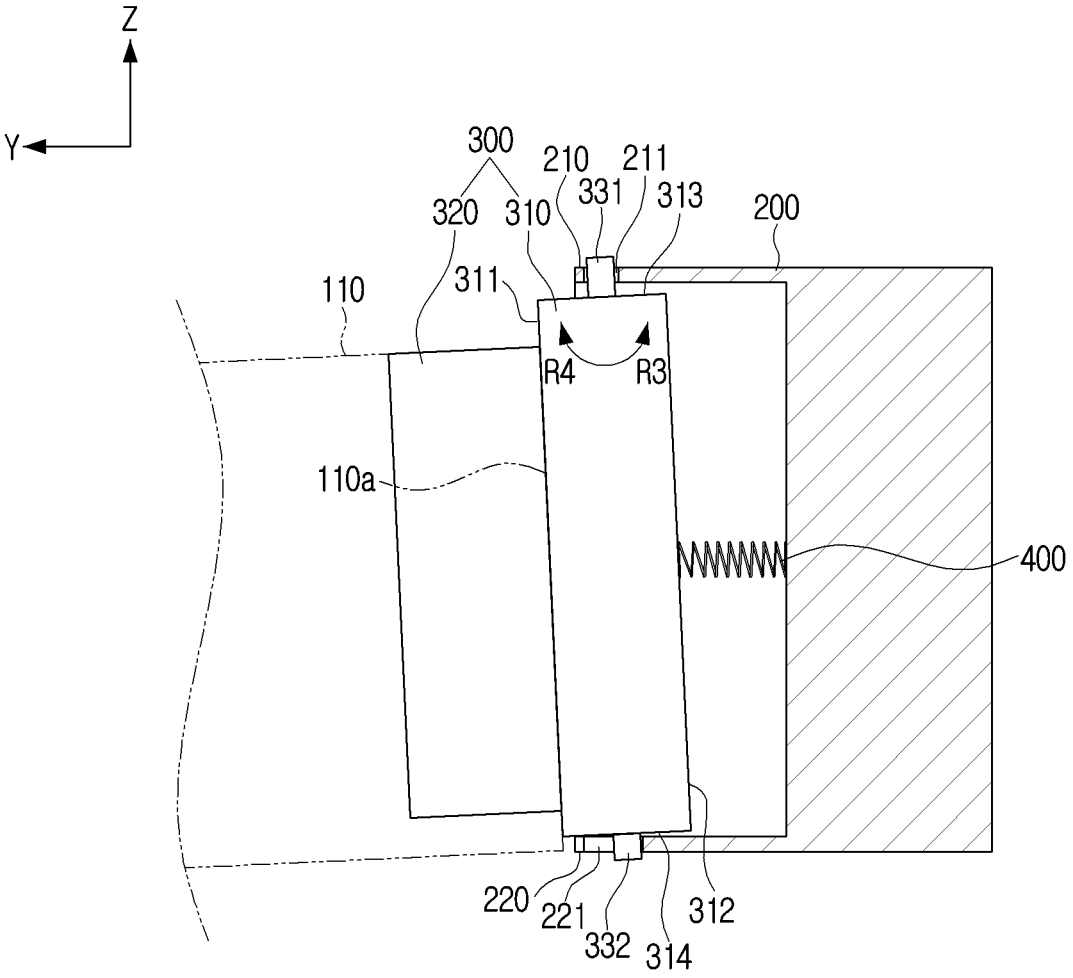
FIG. 13 is a cross-sectional view illustrating an example in which the bush illustrated in FIG. 12 is tilted by the heating belt.

FIG. 12 is a cross-sectional view illustrating a state in which meandering occurs in the heating belt 110 illustrated in FIG. 11. FIG. 13 is a cross-sectional view illustrating a state in which the bush 300 illustrated in FIG. 12 is tilted by the heating belt 110.

Referring to FIGS. 12 and 13, when the heating belt 110 moves toward the side wall 310 in a state rotated obliquely in the third direction R3, the inner surface of the heating belt 110 may press the support member 320 or one end 110*a* thereof may press one point of the side wall 310, and therefore, the bush 300 may rotate in the third direction R3 until the regulating surface 311 and one end 110*a* of the heating belt 110 may be in surface contact with each other based on the first boss 331.

Accordingly, the inner surface and one end 110*a* of the heating belt 110 may be in surface contact with the support member 320 and the side wall 310 of the bush 300, respectively, so that the stress may be dispersed to the surface without being concentrated on one point, thereby making it possible to reduce abrasion occurring at the inner surface and one end 110*a* of the heating belt 110.

Therefore, the bush 300 according to an example is not fixed, and may rotate in the first to fourth directions R1, R2, R3, and R4. That is, the bush 300 may perform rotary motion in two degrees of freedom with respect to the X and Z axes.

For example, as the heating belt 110 inclined in a specific direction presses the bush 300, the bush 300 may be freely rotated so that one end 110*a* of the heating belt 110 is in surface contact with the side wall 310 of the bush 300. Accordingly, because the abrasion occurring at the bush 300 and one end 110*a* of the heating belt 110 is reduced, an effect of extending the lifespan of both components may be expected.

Hereinabove, the disclosure has been described as an illustrative method. The terms used herein are for illustrative purposes and should not be understood in a limiting sense. Various modifications and variations of the disclosure are possible according to the contents described above. Accordingly, the disclosure may be freely implemented within the scope of the claims unless otherwise stated.

What is claimed is:

1. A fuser comprising:

a pressure roller to rotate; and a heating belt to form a fixing nip with the pressure roller;

the heating belt comprises at each end of the heating belt:

a bush to support the heating belt, the bush including a side wall outside of the each end of the heating belt and a support member protruding toward the heating belt based on the side wall to support an inner surface of the heating belt;

a fixing flange to rotatably support the bush;

a rotating ring to rotate by the heating belt; and a plurality of springs to elastically connect between the bush and the fixing flange, to rotate the bush about an axis passing through a first surface of the bush and a second surface of the bush opposite to the first surface of the bush.

2. The fuser as claimed in claim 1, wherein the plurality of springs has one end connected to one surface of the bush and the other end connected to the fixing flange, and is contracted and relaxed in a direction perpendicular to one surface of the bush.

3. The fuser as claimed in claim 1, wherein the plurality of springs have a same free length.

4. The fuser as claimed in claim 1, wherein the plurality of springs are side by side at a same height from a lower side of the bush.

5. The fuser as claimed in claim 1, wherein the support member includes a region on a downstream side of a moving direction of a print medium and inclined downward toward the side wall.

6. The fuser as claimed in claim 1, wherein the support member includes a protrusion protruding from a portion in contact with the rotating ring.

7. The fuser as claimed in claim 1, wherein the bush includes first and second bosses protruding from upper and lower surfaces, respectively, and the fixing flange includes first and second holes into which the first and second bosses are respectively fitted.

8. The fuser as claimed in claim 7, wherein the first hole has a shape corresponding to the first boss, and the second hole has a longer length in a direction perpendicular to one surface of the bush than the first hole.

9. The fuser as claimed in claim 7, wherein the first and second bosses are on a same vertical axis.

10. The fuser as claimed in claim 7, wherein the second hole has a cross section having a quadrangular shape.

11. The fuser as claimed in claim 1, wherein the heating belt includes at least one of polyimide resin or stainless steel.

12. An image forming apparatus comprising:

a photosensitive drum to support a latent image;

a developing machine to supply toner to the photosensitive drum to form a toner image corresponding to the latent image; and a fuser including:

a pressure roller to rotate;

a heating belt to form a fixing nip with the pressure roller; the heating belt comprising at each end of the heating belt:

a bush to support the heating belt, the bush including a side wall outside of the each end of the heating belt and a support member protruding toward the heating belt based on the side wall to support an inner surface of the heating belt, the support member including a region on a downstream side of a moving direction of the print medium and inclined downward toward the side wall;

a fixing flange to rotatably support the bush; and a plurality of springs to elastically connect between the bush and the fixing flange, to rotate the bush about an axis passing through a first surface of the bush and a second surface of the bush opposite to the first surface of the bush.

13. The image forming apparatus as claimed in claim 12, wherein the bush includes first and second bosses protruding from upper and lower surfaces, respectively, and the fixing flange includes first and second holes into which the first and second bosses are respectively fitted.

* * * * *